US010244917B1

(12) United States Patent
Williams

(10) Patent No.: US 10,244,917 B1
(45) Date of Patent: Apr. 2, 2019

(54) DUSTPAN COVER

(71) Applicant: Mikal Williams, Shreveport, LA (US)

(72) Inventor: Mikal Williams, Shreveport, LA (US)

( * ) Notice: Subject to any disclaimer, the term of this patent is extended or adjusted under 35 U.S.C. 154(b) by 0 days.

(21) Appl. No.: 15/895,041

(22) Filed: Feb. 13, 2018

(51) Int. Cl.
*A47L 13/52* (2006.01)

(52) U.S. Cl.
CPC ..... *A47L 13/52* (2013.01)

(58) Field of Classification Search
CPC ..... A47L 13/52
USPC ..... 15/257.1, 257.6
See application file for complete search history.

(56) References Cited

U.S. PATENT DOCUMENTS 119,042 A * 9/1871 Morgan ..... A47L 13/52 15/257.6
586,358 A * 7/1897 Hannigan ..... A47L 13/52 15/257.6
674,516 A * 5/1901 Olson ..... A47L 13/52 15/257.6
678,906 A 7/1901 Rogers
698,834 A * 4/1902 Harris ..... A47L 13/52 15/257.6
760,467 A * 5/1904 Michaud ..... A47L 13/52 15/257.6
803,204 A * 10/1905 Widmer ..... A47L 13/52 15/257.6
953,756 A 4/1910 Olson
1,410,369 A 3/1922 Chagnon
1,683,517 A 9/1928 Bentley
2,219,216 A * 10/1940 Anderson ..... A47L 13/52 15/257.6
2,496,735 A 2/1950 Francis
D470,289 S 2/2003 Petner
6,732,402 B1 5/2004 Hsu
D633,267 S 2/2011 Caleca
9,386,901 B1 7/2016 Baker

* cited by examiner

*Primary Examiner* — Randall Chin

(57) ABSTRACT

The dustpan cover is a cleaning device. The dustpan cover is configured for use in collecting debris from a horizontal surface. The dustpan cover comprises a dustpan, a lid, and a fastener. The fastener attaches the lid to the dustpan. The lid is a barrier that controls access to the dustpan. The dustpan is a traditional cleaning tool used to collect debris from a horizontal surface such as a floor. The lid rotates relative to the dustpan such that the dustpan opens and closes for the collection and disposal of debris.

5 Claims, 3 Drawing Sheets

DUSTPAN COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including articles for domestic cleaning, more specifically, a dustpan.

SUMMARY OF INVENTION

The dustpan cover is a cleaning device. The dustpan cover is configured for use in collecting debris from a horizontal surface. The dustpan cover comprises a dustpan, a lid, and a fastener. The fastener attaches the lid to the dustpan. The lid is a barrier that controls access to the dustpan. The dustpan is a traditional cleaning tool used to collect debris from a horizontal surface such as a floor. The lid rotates relative to the dustpan such that the dustpan opens and closes for the collection and disposal of debris.

These together with additional objects, features and advantages of the dustpan cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the dustpan cover in detail, it is to be understood that the dustpan cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dustpan cover.

It is therefore important that the claims be regarded as including such equivalent construction insofar as they do not depart from the spirit and scope of the dustpan cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
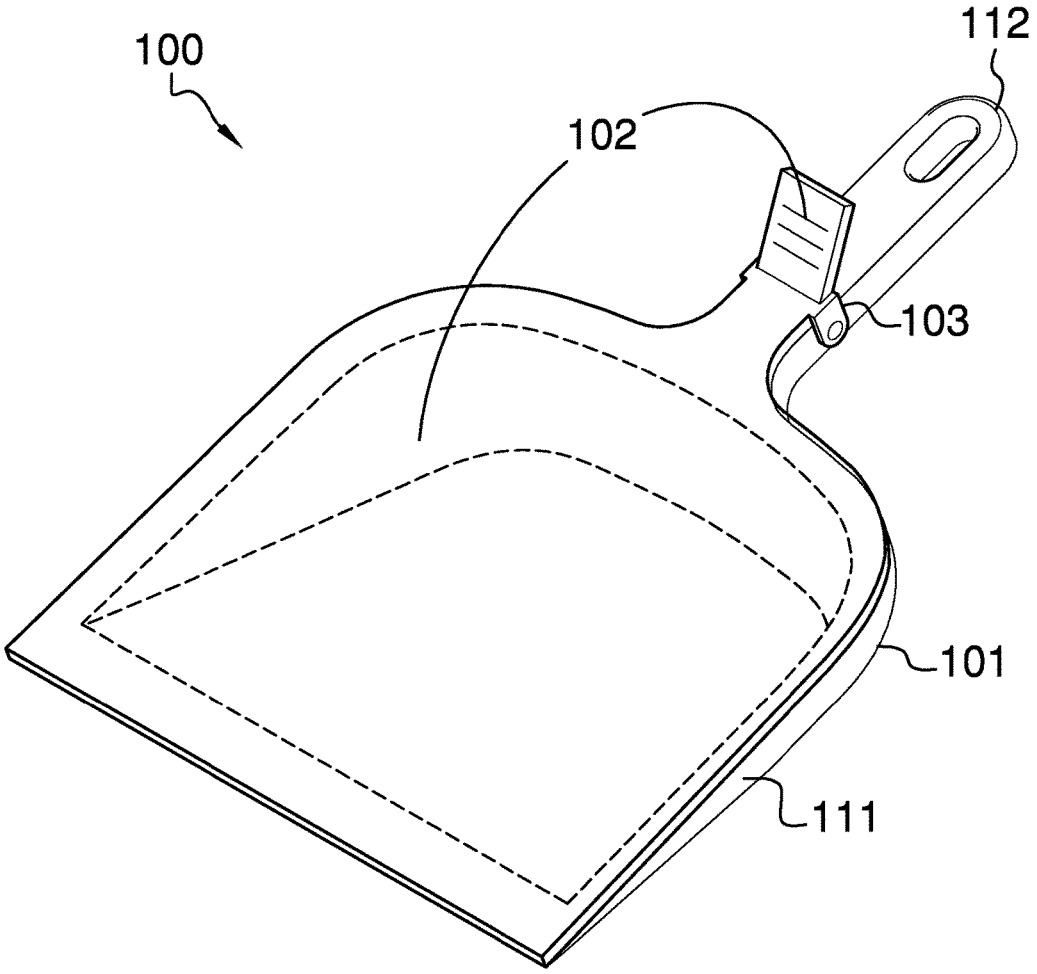
FIG. 1 is a perspective view of an embodiment of the disclosure.
Figure 2:
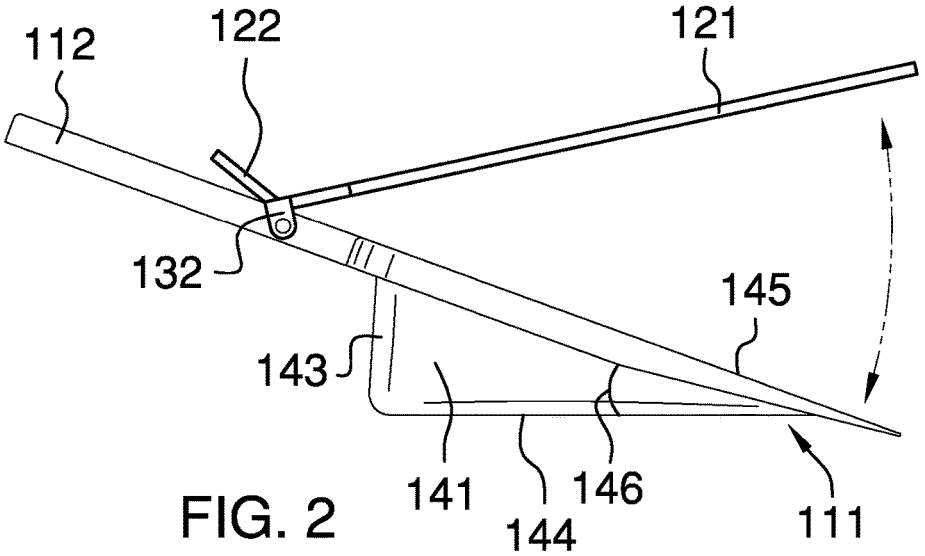
FIG. 2 is an opened side view of an embodiment of the disclosure.
Figure 3:
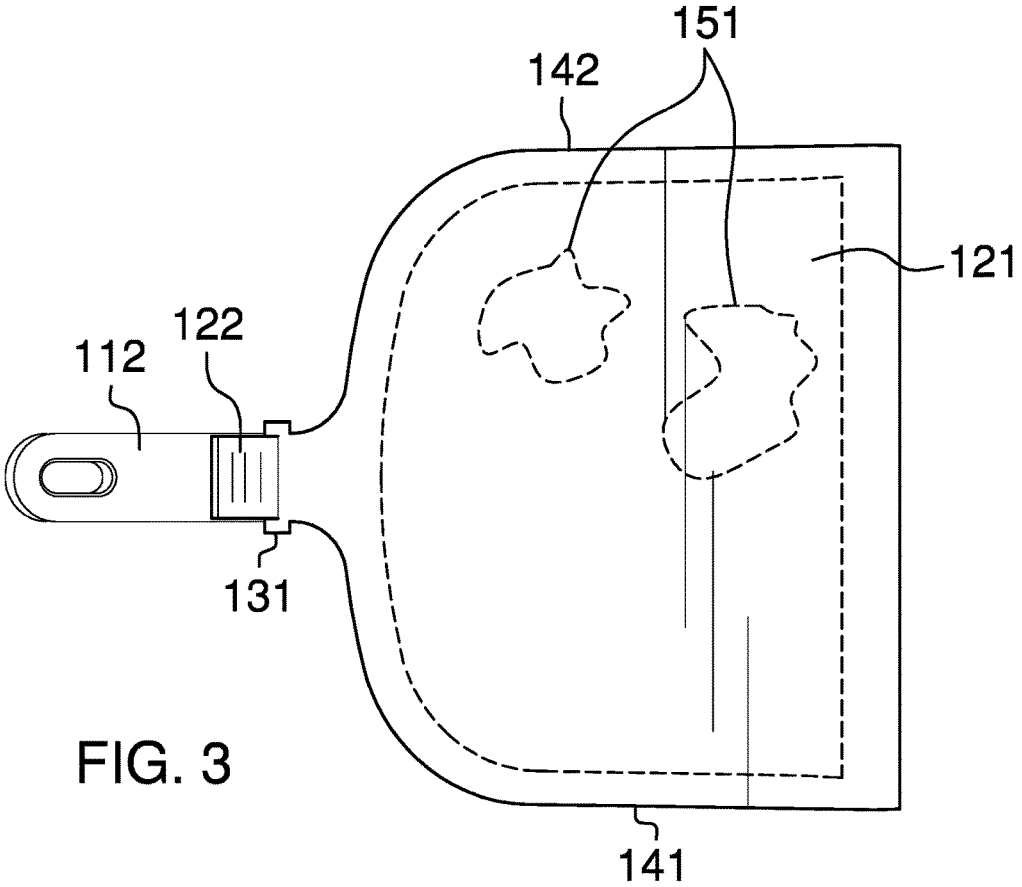
FIG. 3 is a top view of an embodiment of the disclosure.
Figure 4:
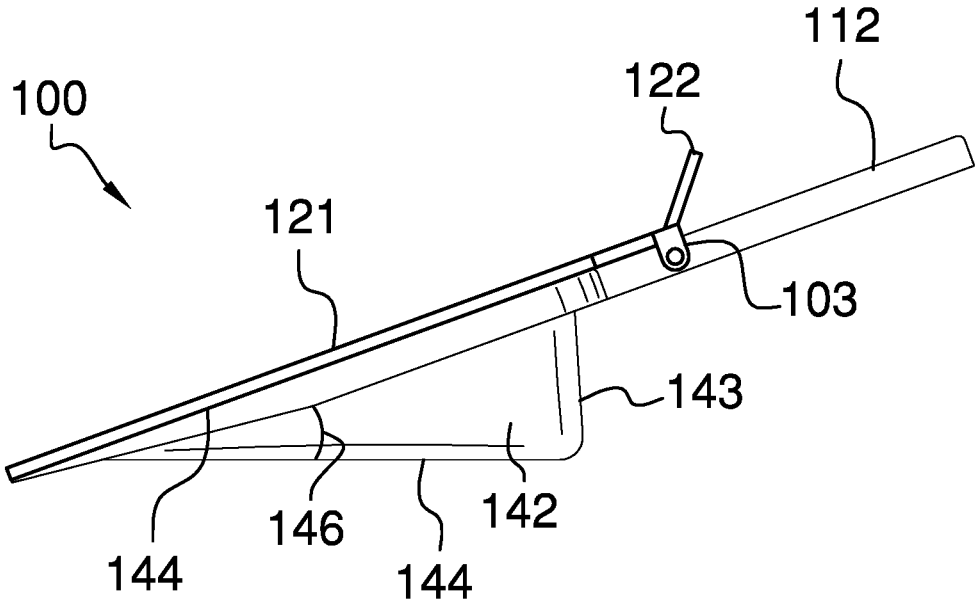
FIG. 4 is a closed side view of an embodiment of the disclosure.

Detailed reference will now be made to one or more potential embodiments of the disclosure, which are illustrated in FIGS. 1 through 4.

The dustpan cover 100 (hereinafter invention) is a cleaning device. The invention 100 is configured for use in collecting debris 151 from a horizontal surface. The invention 100 comprises a dustpan 101, a lid 102 and a fastener 103. The fastener 103 attaches the lid 102 to the dustpan 101. The lid 102 is a barrier that controls access to the dustpan 101. The dustpan 101 is a traditional cleaning tool used to collect debris 151 from a horizontal surface such as a floor. The lid 102 rotates relative to the dustpan 101 such that the dustpan 101 opens and closes for the collection and disposal of debris 151.

The dustpan 101 is a wedge-shaped containment structure. The dustpan 101 is a traditional device used to collect debris 151 from horizontal surfaces. The use of a dustpan 101 is well-known and documented in domestic environments. The dustpan 101 comprises a collection bin 111 and a handle 112.

The collection bin 111 is a hollow containment structure. The collection bin 111 is a wedge-shaped structure. The details of the wedge shape of the collection bin 111 are described elsewhere in this disclosure. The collection bin 111 contains the debris 151 during normal use of the invention 100. The collection bin 111 comprises a first vertical face 141, a second vertical face 142, a third vertical face 143, an inferior face 144, a superior face 145, and a wedge cant 146. The superior face 145 is an open face that provides access for the introduction and removal of the debris 151.

The first vertical face 141 is a triangularly shaped plate that projects perpendicularly away from the inferior face 144. The first vertical face 141 shares its perimeter with the third vertical face 143, the inferior face 144, and the superior face 145. The second vertical face 142 is a triangularly shaped plate that projects perpendicularly away from the inferior face 144. The second vertical face 142 shares its perimeter with the third vertical face 143, the inferior face 144, and the superior face 145. The second vertical face 142 is distal from the first vertical face 141. The third vertical face 143 is a rectangular plate that projects perpendicularly away from the inferior face 144. The third vertical face 143 shares its perimeter with the first vertical face 141, the third vertical face 143, the inferior face 144, and the superior face 145. The third vertical face 143 is distal from the line formed by the intersection of the inferior face 144 and the superior face 145.

The inferior face 144 is a rectangular plate. The inferior face 144 shares its perimeter with the first vertical face 141, the second vertical face 142, the third vertical face 143, and the inferior face 144. The superior face 145 is a rectangular plate. The superior face 145 shares its perimeter with the first vertical face 141, the second vertical face 142, the third vertical face 143, and the inferior face 144. The inferior face 144 and the superior face 145 are not parallel planar surfaces. The acute angle formed between the inferior face 144 and the superior face 145 is called the wedge cant 146.

The handle 112 attaches to the collection bin 111. The handle 112 is a shaft that forms a grip used to manipulate the dustpan 101. The handle 112 attaches to the third vertical face 143 of the collection bin 111. In the first potential embodiment of the disclosure, the handle 112 attaches to the third vertical face 143 such that: 1) the handle 112 projects away from the intersection of the inferior face 144 and the superior face 145; and, 2) the handle 112 forms a grip cant with the inferior face 144. The arc of the grip cant between the handle 112 and the inferior face 144 equals the arc of the wedge cant 146.

The lid 102 is a covering that encloses the containment space of the dustpan 101. The lid 102 controls access to the storage space within the dustpan 101. The lid 102 rotates relative to the dustpan 101 to "open" and "close" access to the dustpan 101. The lid 102 comprises a barrier plate 121 and a lever plate 122.

The barrier plate 121 is a plate structure. The perimeter of the barrier plate 121 is geometrically similar to the perimeter of the superior face 145 of the collection bin 111. The span of the perimeter of the barrier plate 121 is greater than the span of the perimeter of the superior face 145 such that the barrier plate 121 will cover and enclose the superior face 145 when the lid 102 is in a closed position. The fastener 103 attaches the barrier plate 121 to the handle 112 of the dustpan 101.

The lever plate 122 is a thumb grip. The lever plate 122 attaches to the fastener 103. The lever plate 122 provides the leverage to allow a thumb to apply a torque to the fastener 103 that rotates the barrier plate 121 relative to the collection bin 111.

The fastener 103 attaches the lid 102 to the dustpan 101. The fastener 103 is a spring-loaded device. The fastener 103 attaches the lid 102 to the dustpan 101 such that the lid 102 rotates towards and away from the superior face 145 of the collection bin 111. In the relaxed shape, the fastener 103 seals the lid 102 against the superior face 145 of the collection bin 111. The fastener 103 comprises a hinge 131 and a spring 132.

The barrier plate 121 and the lever plate 122 attach to the hinge 131. The hinge 131 is a commercially available hardware item that allows the barrier plate 121 to rotate relative to the collection bin 111. The design and use of the hinge 131 are well-known and documented in the mechanical arts. The lever plate 122 attaches to the hinge 131 such that a force applied to the lever plate 122 will rotate the barrier plate 121. The use of leverage devices to rotate objects is well-known and documented in the mechanical arts.

The spring 132 is a commercially available torsion spring 132 that is incorporated in the hinge 131. When the lid 102 is separated from the dustpan 101, a torque is applied to the spring 132 such that the spring 132 attempts to return the lid 102 and the dustpan 101 to the relaxed shape. When the spring 132 is in its relaxed shape, the lid 102 is securely positioned against the superior face 145 of the collection bin 111.

The following definitions were used in this disclosure:

Arc: As used in this disclosure, an arc refers to a portion of a circumference or a curved perimeter. When applied to an angle, the arc also refers to a measure of an angular span as measured from a circle at the vertex formed by the sides of the angle.

Cant: As used in this disclosure, a cant is an angular deviation from one or more reference lines (or planes) such as a vertical line (or plane) or a horizontal line (or plane).

Correspond: As used in this disclosure, the term correspond is used as a comparison between two or more objects wherein one or more properties shared by the two or more objects match, agree, or align within acceptable manufacturing tolerances.

Debris: As used in this disclosure, debris refers to an accumulation of loose and unwanted material on a surface.

Fastener: As used in this disclosure, a fastener is a device that is used to join or affix a first object to a second object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to an edge or surface of an object that would commonly be referred to as the bottom of the object.

Lever: As used in this disclosure, a lever is a simple machine that comprises a shaft that rotates around a fulcrum or pivot point.

Lid: As used in this disclosure, a lid is a removable cover that is placed over an opening of a hollow structure to enclose the hollow structure.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance. As defined in this disclosure, plates may be made of any material, but are commonly made of metal, plastic, and wood. When made of wood, a plate is often referred to as a board.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Shaft: As used in this disclosure, the term shaft is used to describe a rigid prism that is often used as the handle of a tool or implement. The terms inner dimension of the shaft and outer dimension of the shaft are used as they would be used by those skilled in the plumbing arts. The definition of shaft explicitly includes solid shafts or shafts that are formed more like pipes with a hollow passage through the shaft that runs along the center axis of the shaft prism.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Superior: As used in this disclosure, the term superior refers to an edge or surface of an object that would commonly be referred to as the top of the object.

Torque: As used in this disclosure, a torque refers to a force that causes an object to rotate.

Torsion: As used in this disclosure, torsion refers to the application of torque to an object.

Torsion Spring: As used in this disclosure, a torsion spring is a mechanical device that stores mechanical energy through an opposing torque when the mechanical device is twisted. The torsion spring will return to its original relaxed shape when the twisting force is removed.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wedge: As used in this disclosure, a wedge is an inclined planar structure comprising an inferior face, a first vertical face, a second vertical face, and a third vertical face. The inferior face has a rectangular shape. The superior face has a rectangular shape. The superior face intersects the inferior face to form a wedge cant. The first vertical face and the second vertical face are triangular faces. The second vertical face is distal from the first vertical face. The third vertical face is a rectangular face that is distal from the line formed by the intersection of the inferior face and the superior face. The first vertical face, the second vertical face, and the third vertical face project perpendicularly away from the inferior face.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A domestic cleaning apparatus comprising:

a dustpan, a lid, and a fastener;

wherein the fastener attaches the lid to the dustpan;

wherein the lid is a barrier that controls access to the dustpan;

wherein the domestic cleaning apparatus is configured to collect debris;

wherein the dustpan is configured to collect debris;

wherein the lid rotates relative to the dustpan such that the dustpan opens and closes for the collection and disposal of debris;

wherein the dustpan is a containment structure;

wherein the dustpan is a wedge-shaped structure;

wherein the lid controls access to a storage space within the dustpan;
wherein the lid rotates relative to the dustpan;
wherein the fastener is a spring-loaded device;
wherein the fastener attaches the lid to the dustpan such that the lid rotates towards and away from a superior face of a collection bin;
wherein the fastener seals the lid against the superior face of the collection bin;
wherein the dustpan comprises a collection bin and a handle;
wherein the handle attaches to the collection bin;
wherein the collection bin contains the debris;
wherein the collection bin is a hollow containment structure;
wherein the collection bin is a wedge-shaped structure;
wherein the collection bin comprises a first vertical face, a second vertical face, a third vertical face, an inferior face, a superior face, and a wedge cant;
wherein the superior face is an open face;
wherein the first vertical face, the second vertical face, the third vertical face, the inferior face, the superior face combine to form the wedge shape of the containment bin;
wherein the wedge cant is the angle between the inferior face and the superior face;
wherein the first vertical face is a triangularly shaped plate;
wherein the second vertical face is a triangularly shaped plate;
wherein the third vertical face is a rectangular plate;
wherein the inferior face is a rectangular plate;
wherein the superior face is a rectangular plate;
wherein the first vertical face projects perpendicularly away from the inferior face;
wherein the second vertical face projects perpendicularly away from the inferior face;
wherein the third vertical face projects perpendicularly away from the inferior face;
wherein the first vertical face shares its perimeter with the third vertical face, the inferior face, and the superior face;
wherein the second vertical face shares its perimeter with the third vertical face, the inferior face, and the superior face;
wherein the third vertical face shares its perimeter with the first vertical face, the inferior face, and the superior face;
wherein the superior face shares its perimeter with the first vertical face, the second vertical face, the third vertical face, and the inferior face;
wherein the second vertical face is distal from the first vertical face;
wherein the third vertical face is distal from the line formed by the intersection of the inferior face and the superior face;
wherein the inferior face and the superior face are not parallel planar surfaces;
wherein a wedge angle is the acute angle formed between the inferior face and the superior face;
wherein the handle is a shaft;
wherein the handle is used as a grip;
wherein the handle attaches to the third vertical face of the collection bin;
wherein the handle attaches to the third vertical face such that the handle projects away from the intersection of the inferior face and the superior face;
wherein the handle attaches to the third vertical face such that the handle forms a grip cant with the inferior face;
wherein the span of the arc of the grip cant between the handle and the inferior face equals the span of the arc of the wedge cant;
wherein the lid encloses a containment space of the dustpan;
wherein the lid comprises a barrier plate and a lever plate;
wherein the barrier plate attaches to the fastener;
wherein the lever plate attaches to the fastener;
wherein the barrier plate is a plate structure;
wherein the perimeter of the barrier plate is geometrically similar to the perimeter of the superior face of the collection bin;
wherein the span of the perimeter of the barrier plate is greater than the span of the perimeter of the superior face.

2. The domestic cleaning apparatus according to claim 1 wherein the fastener attaches the barrier plate to the handle of the dustpan.

3. The domestic cleaning apparatus according to claim 2
wherein the fastener comprises a hinge and a spring;
wherein the spring is incorporated into the hinge;
wherein the barrier plate and the lever plate attach to the hinge.

4. The domestic cleaning apparatus according to claim 3
wherein the hinge rotates the barrier plate relative to the collection bin;
wherein the lever plate is a leverage device;
wherein the lever plate attaches to the hinge such that a force applied to the lever plate will rotate the barrier plate.

5. The domestic cleaning apparatus according to claim 4
wherein the spring torsion spring;
wherein a torque is applied to the spring such that the spring attempts to return the lid and the dustpan to the relaxed shape;
wherein when the spring is in its relaxed shape the lid seals the superior face of the collection bin.

* * * * *